US005163838A

United States Patent [19]

Tura, Jr. et al.

[11] Patent Number: 5,163,838

[45] Date of Patent: Nov. 17, 1992

[54] SHIELDED SPARK PLUG BOOT ASSEMBLY

[75] Inventors: Vincent J. Tura, Jr., Niles; Michael J. Bezusko, Warren, both of Ohio

[73] Assignee: General Motors Corporation, Detroit, Mich.

[21] Appl. No.: 803,810

[22] Filed: Dec. 9, 1991

[51] Int. Cl.[5] ..... H01R 13/648

[52] U.S. Cl. ..... 439/126; 123/169 PA

[58] Field of Search ..... 439/125, 126, 127, 128; 123/169 PA, 169 PH

[56] References Cited

U.S. PATENT DOCUMENTS

| | | | |
|---|---|---|---|
| 1,999,118 | 4/1935 | Simsack | 439/126 |
| 2,310,572 | 11/1942 | Nowosielski | 439/126 |
| 3,105,480 | 10/1963 | Farris | 123/169 PA |
| 3,128,139 | 4/1964 | Estes | 339/26 |
| 4,159,441 | 6/1979 | Livingston | 439/126 |
| 4,497,532 | 2/1985 | Bezusko et al. | 339/112 R |

*Primary Examiner*—Gary F. Paumen

*Attorney, Agent, or Firm*—Francis J. Fodale

[57] ABSTRACT

A shielded spark plug boot assembly for an ignition cable connector has a tubular elastomeric boot having a cable end portion that receives an ignition cable, an intermediate cavity portion that houses a terminal at the end of the ignition cable, and a seal end portion that receives a spark plug and seals around an insulator thereof. The shielded spark plug boot assembly also has a heat shield and a coil spring. The heat shield is mounted on the cable end portion of the elastomeric boot and it includes a metal shell that has a lower end portion which extends below the seal end portion of the elastomeric boot and which includes a conical portion that leads to a collar of reduced diameter at the lower end of the heat shield. The coil spring has an upper conical portion that is disposed and retained in the conical portion of the metal shell and a lower cylindrical portion that protrudes through the collar at the lower end of the heat shield and engages a metal portion of the spark plug to ground the heat shield electrically.

6 Claims, 1 Drawing Sheet

SHIELDED SPARK PLUG BOOT ASSEMBLY

BACKGROUND OF THE INVENTION

This invention relates generally to shielded spark plug boot assemblies and more specifically to shielded spark plug boot assemblies having an electrically conductive housing or shell that is grounded to the metal shell of the spark plug.

It is already known from U.S. Pat. No. 4,497,532 granted to Michael J. Bezusko; Daniel P. Liska and Joseph A. McGee Feb. 5, 1985 to provide a heat shielded, spark plug boot assembly 10 comprising an outer metal shell 46 that has ears 54 or 64 that engage the metal shell 24 of a spark plug for grounding the electrically conductive outer metal shell 46. This patent also shows a heat shielded, spark plug boot assembly 70 comprising a laminate tube 72 that has a circumferential bead 74 for this purpose.

Heat shielded, spark plug boot assemblies of the above type that have grounding ears on the bottom of the outer metal shell have been manufactured and used successfully by General Motors Corporation for several years. Even though these assemblies are entirely satisfactory from several standpoints, the assemblies require a relatively high engagement force because of the nature of the grounding ears. These ears need to engage the metal shell of the spark plug with a relatively high interference fit to compensate for their low spring force characteristics.

It is also already know from U.S. Pat. No. 3,128,139 granted to Stanley E. Estes Apr. 7, 1964 to provide a spark plug shield 10 that includes a leaf spring 29 that is disposed inside an electrically conductive housing 13. The leaf spring 29 engages the metal shell 14 of a spark plug 11 to ground the electrically conductive housing 13 when the shield 10 is plugged onto the spark plug 11.

The spark plug shield of this patent does not require a high engagement force to plug the shield onto the spark plug because of the nature of the grounding leaf spring. However, the leaf spring has a relatively low spring force characteristic and is damaged easily if the shield is not plugged onto the spark plug carefully.

It is also already known, in Europe at least, from a spark plug shield that is used on an Adam Opel Calibra automobile to provide a spark plug shield that includes a coil spring for grounding the electrically conductive metal shell of the shield to the metal shell of a spark plug. This spark plug shield does not require a high engagement force and the coil spring clearly has adequate spring force characteristics to maintain the grounding connection. However, the coil spring is attached to the end of the metal shell and entirely exposed so that the spark plug shield is susceptible to entanglement during shipment.

SUMMARY OF THE INVENTION

The object of this invention is to provide an improved shielded spark plug boot assembly that is plugged on a spark plug easily and grounded to the spark plug by a coil spring that is not susceptible to entanglement during handling.

A feature of the invention is that the shielded spark plug boot assembly has a coil spring that engages the spark plug with adequate force to maintain the grounding connection.

Another feature of the invention is that the shielded spark plug boot assembly has a coil spring for grounding a metal shell of the shielded spark plug boot assembly to the spark plug that protrudes from the metal shell a minimal amount to avoid entanglement during handling.

Still another feature of the invention is that the shielded spark plug boot assembly has a coil spring for grounding a metal shell of the shielded spark plug boot assembly to the spark plug that is easily attached inside the metal shell.

Still yet another feature of the invention is that the shielded spark plug boot assembly has a metal shell and a coil spring for grounding a metal shell of the shielded spark plug boot assembly to the spark plug that have cooperating conical portions to facilitate attachment of the coin spring inside the metal shell.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
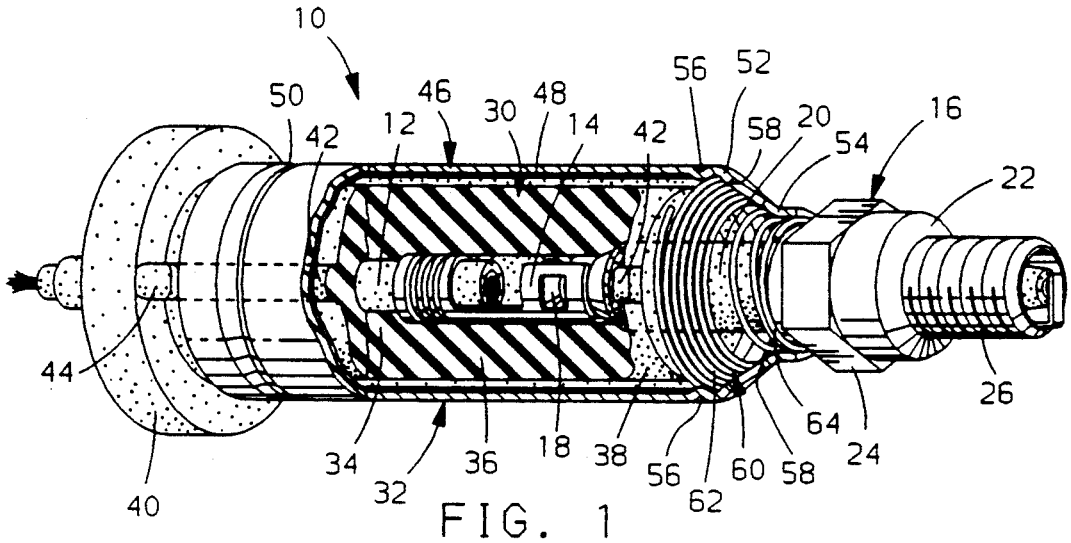
FIG. 1 is a cut away perspective view of a shielded spark plug boot assembly in accordance with our invention.
Figure 2:
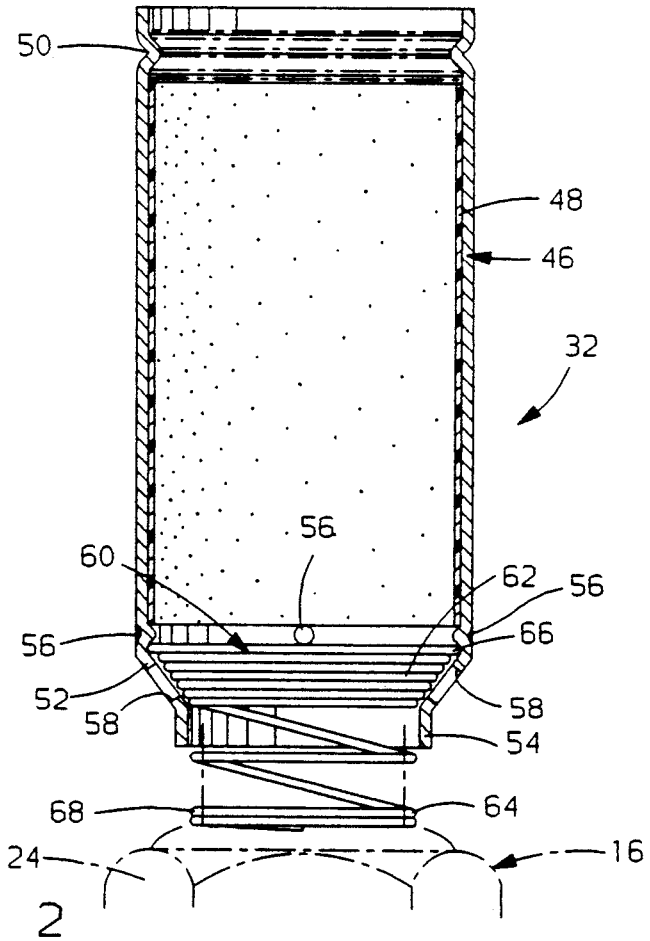
FIG. 2 is longitudinal section of the heat shield and coil spring forming part of the shielded spark plug boot assembly that is illustrated in FIG. 1.

Referring now to the drawing and, more particularly to FIG. 1, a shielded spark plug boot assembly 10 in accordance with our invention is illustrated in conjunction with an ignition cable 12, a socket terminal 14 and a spark plug 16.

The ignition cable 12 is a high energy T.V.R.S. cable which has a nonmetallic conductive core and a high temperature silicone insulation jacket. The socket terminal 14 is attached to the end of the ignition cable by a conventional strip and fold technique and may be of any suitable design for connection to the spark plug 16.

The spark plug 16 is likewise of conventional design and standard configuration. It comprises a stud terminal 18 which plugs into the socket terminal 14, a ceramic insulator 20 and a metal base 22 having a hex head 24 and a threaded shank 26 by means of which the spark plug 16 is screwed into an engine block (not shown).

The shielded spark plug boot assembly 10 comprises an elastomeric spark plug boot 30 of elongated tubular shape and a heat shield 32. The elastomeric boot 30 has a cable end portion 34, an intermediate cavity portion 36 and a seal end portion 38. The cable end portion 34 has a bore which is sized so as to sealingly engage around the silicone jacket of the ignition cable 12. The bore of the intermediate cavity portion 36 is somewhat larger to provide room for the socket terminal 14 attached to the end of the ignition cable 12. The bore of the seal end 38 is sized to sealingly engage around the ceramic insulator of the spark plug 16 as shown in FIG. 1.

The spark plug boot 30 has a round head 40 at the cable end which serves as a finger grip for connecting and disconnecting the assembly 10 from the spark plug 16. The outside of the boot 30 has three integral circumferentially spaced longitudinal ribs 42 that are semi-circular in cross section. These ribs extend from the head 40 to the seal end of the boot 30 as shown in FIG. 1. The boot 30 also has three integral stop lugs 44 which are integrally attached to the head 40 and a respective one of the ribs 42. The outer periphery of the boot 30 (including the ribs 42 and the portion therebetween) tapers slightly in the longitudinal direction from the cable end to the seal end so as to facilitate insertion into the heat shield 32.

The heat shield 32 comprises an outer metal shell 46 and an inner dielectric barrier 48. The inner dielectric barrier 48 is a thin, spiral wound roll of high temperature dielectric material. It has been found that a laminate consisting of an inner Kapton film layer of 0.08 millimeters (3 mils) thickness and an outer Nomex paper layer of 0.05 millimeters (2 mils) thickness is suitable. Kapton is the trademark for the polyimide films of DuPont, while Nomex is their trademark for heat resistant aromatic polyamide fibers.

It is also possible to use other high temperature dielectric films, such as Teflon and Mylar. Teflon is the DuPont trademark for polytetrafluoroethylene while Mylar is the DuPont trademark for their polyester.

It is likewise possible to use spray and powder coatings of high temperature dielectric materials such as Ryton, epoxy, silicone, fluoropolymers and enamels which can be applied either to a paper layer or directly to the outer metal shell 46. Ryton is the trademark of Phillips Chemical Company for polyphenylene sulfide.

The outer metal shell 46 is preferably made of aluminum for cost and weight savings. The shell 46 has a circumferential bead 50 rolled in adjacent an upper end and a conical portion 52 leading to a collar 54 of reduced diameter at the opposite lower end. The shell 46 has four circumferential spaced dimples or indentations 56 at the upper end of the conical portion 52. The conical portion 52 also has four circumferentially spaced cooling holes 58.

The inner dielectric barrier 48 fits snugly inside the outer metal shell 46 and extends from the circumferential bead 50 to the dimples 56. The bead 50 and the dimples 56 retain the dielectric barrier 48 in the longitudinal direction.

The heat shield 32 is mounted on the elastomeric boot 30 so that the end adjacent the circumferential bead 50 abuts the stop lugs 44 and the conical portion 52 and collar 54 are located below the seal end of the elastomeric boot 30. This provides space for mounting a coil spring 60 inside the head shield 32 that protrudes through the collar 54 and engages the hex head 24 of the spark plug base 22. The heat shield 32 is retained on the elastomeric boot 30 by the interference fit of the circumferential bead 50 on the longitudinal ribs 42.

The coil spring 60 comprises an upper conical portion 62 and a lower cylindrical portion 64. The upper conical portion 62 is preferably spiral wound so that it can be depressed into a flat configuration and the end coil 66 is sized for entrapment between the upper end of the conical portion 52 of the metal shell 46 and the dimples 56 as shown in FIG. 1. The rest of the upper conical portion 62 is preferably spaced from the conical portion 52 of the metal shell 46 by a small amount even when the coil spring is not stressed to minimize heat transfer from the metal shell 46 to the coil spring 60.

The lower cylindrical portion 64 of the coil spring 60 preferably has a diameter that is just slightly smaller than the inner diameter of the collar 54 to stabilize the protruding lower end of the coil spring 60 without interfering with free plunging movement of the lower cylindrical portion 64 relative to the collar 54. The lower end of the coil spring 60 also preferably has a pair of abutting coils at its terminus 68 which provide a firm engagement with the top of the hex head 24 when the shielded spark plug boot assembly 10 is plugged onto the spark plug 16.

The coil spring 60 is easily attached inside the head shield 32 simply by dropping the coil spring 60, terminus 68 first, into the heat shield 32 and pressing against the end coil 66 until it snaps into position between the upper end of the conical portion 52 of the metal shell 46 and the dimples 56.

When the coil spring 60 is attached inside the heat shield 32, the lower cylindrical portion 64 protrudes through the collar 54 a minimal amount. For instance we have found that a coil spring having a height of about 14 mm need only protrude about 6 mm below the collar 54 in order to maintain a good grounding connection with the top of the hex head 24 when the shielded spark plug boot assembly is plugged onto the spark plug 16.

The elastomeric boot 30 and the heat shield 32 are also configured to provide for convection cooling by air flow between the elastomeric boot 30 and the heat shield 32. More specifically, the mounting of the heat shield 32 on longitudinal ribs 42 provides a plurality of longitudinal air flow passages between the respective ribs 42. The spaces between the lugs 44 of the elastomeric boot 30 provide openings for the air flow passages at the upper end of the heat shield 32 while the cooling holes 58 in the conical portion 52 of the metal shell 46 provide openings for the air flow passages to the exterior of the heat shield 32 at the lower end.

We wish it to be understood that we do not desire to be limited to the exact details of construction shown and described, for obvious modifications will occur to a person skilled in the art.

The embodiments of the invention in which an exclusive property or privilege is claimed are defined as follows:

1. In a shielded spark plug boot assembly for an ignition cable connector having a tubular elastomeric boot having a cable end portion for receiving an ignition cable, an intermediate cavity portion for housing a terminal at the end of the ignition cable, and a seal end portion for receiving a spark plug and sealing around an insulator thereof and a heat shield which is mounted on the cable end portion of the elastomeric boot and which extends below the seal end portions of the elastomeric boot for engaging a ground member, the improvement comprising:

the heat shield having a metal shell that has a lower end portion which extends below the seal end portion of the elastomeric boot and which includes a conical portion that leads to a collar of reduced diameter at the lower end of the heat seal, and the shielded spark plug boot assembly further including a coil spring that extends below the collar for engaging a metal portion of a spark plug and grounding the heat shield when the shielded spark plug boot assembly is plugged onto a spark plug, the coil spring having an upper conical portion that is disposed in the conical portion of the metal shell and that has an end coil that is captured between the upper end of the conical portion of the metal shell and indentation means at the upper end of the conical portion of the metal shell for mounting the coil spring inside the metal shell, and the coil spring having a lower cylindrical portion that protrudes through the collar at the lower end of the heat shield and that has a pair of abutting coils at its terminus to provide a firm engagement with a top surface of the metal portion of the spark plug when the shielded spark plug boot assembly is plugged onto a spark plug.

2. In a shielded spark plug boot assembly for an ignition cable connector having a tubular elastomeric boot having a cable end portion for receiving an ignition cable, an intermediate cavity portion for housing a terminal at the end of the ignition cable, and a seal end portion for receiving a spark plug and sealing around an insulator thereof and a heat shield which is mounted on the cable end portion of the elastomeric boot and which extends below the seal end portions of the elastomeric boot for engaging a ground member, the improvement comprising:

the heat shield having a metal shell that has a lower end portion which extends below the seal end portion of the elastomeric boot and which includes a conical portion that leads to a collar of reduced diameter at the lower end of the heat shield, and the shielded spark plug boot assembly further including a coil spring that extends below the collar for engaging a metal portion of a spark plug and grounding the heat shield when the shielded spark plug boot assembly is plugged onto a spark plug, the coil spring having an upper conical portion that is disposed in the conical portion of the metal shell and mounted inside the metal shell by indentation means at an upper end of the conical portion of the metal shell, the coil spring having a lower cylindrical portion that protrudes through the collar at the lower end of the heat shield.

3. In a shielded spark plug boot assembly for an ignition cable connector as defined in claim 2, the improvement further comprising, the upper conical portion of the coil spring having an end coil that is snapped into a captured position between the upper end of the conical portion of the metal shell and the indentation means at the upper end of the conical portion of the metal shell.

4. In a shielded spark plug boot assembly for an ignition cable connector as defined in claim 2, the improvement further comprising, the upper conical portion of the coil spring having an end coil that is captured between the upper end of the conical portion of the metal shell and a plurality of indents at the upper end of the conical portion of the metal shell.

5. In a shielded spark plug boot assembly for an ignition cable connector as defined in claim 2, the improvement further comprising, the lower cylindrical portion of the spring having a pair of abutting coils at its terminus to provide a firm engagement with a top surface of the metal portion of the spark plug when the shielded spark plug boot assembly is plugged onto a spark plug.

6. In a shielded spark plug boot assembly for an ignition cable connector as defined in claim 3, the improvement further comprising, the lower cylindrical portion of the spring having a pair of abutting coils at its terminus to provide a firm engagement with a top surface of the metal portion of the spark plug when the shielded spark plug boot assembly is plugged onto a spark plug.

* * * * *